US006038946A

United States Patent [19]

Jackson et al.

[11] Patent Number: 6,038,946

[45] Date of Patent: Mar. 21, 2000

[54] AXIALLY REPOSITIONABLE ADAPTER FOR USE WITH A RATCHET ASSEMBLY

[76] Inventors: Roger Lee Jackson, 943 E. Paulson, Lansing, Mich. 48906-2036; Mark E. Jackson, 1311 Hickory Rd., Lansing, Mich. 48906

[21] Appl. No.: 08/858,372

[22] Filed: May 19, 1997

[51] Int. Cl.[7] ..... B25B 23/16

[52] U.S. Cl. ..... 81/177.2

[58] Field of Search ..... 81/177.1, 177.2, 81/104, 108, 109, 326, 330, 376, 377, 378; 403/379

[56] References Cited

U.S. PATENT DOCUMENTS

| | | | |
|---|---|---|---|
| 1,030,592 | 6/1912 | Leland . | |
| 1,269,413 | 6/1918 | Finnigan | 81/177.2 |
| 1,370,820 | 3/1921 | Johnson | 81/177.2 |
| 2,382,291 | 8/1945 | Carlberg | 81/177.2 |
| 2,438,633 | 3/1948 | Condor | 81/177.2 |
| 2,592,978 | 4/1952 | Trimboli . | |
| 2,758,494 | 8/1956 | Jenkins . | |
| 2,869,410 | 1/1959 | Prichard . | |
| 2,963,930 | 12/1960 | Clothier et al. . | |
| 3,306,639 | 2/1967 | Lyon . | |
| 4,376,397 | 3/1983 | Newby et al. | 81/177.2 |
| 4,409,866 | 10/1983 | McBride . | |
| 4,602,890 | 7/1986 | Duda . | |
| 4,960,015 | 10/1990 | Mathews | 81/177.2 |
| 5,033,337 | 7/1991 | Thomas, III | 81/177.2 |
| 5,109,737 | 5/1992 | Raber . | |
| 5,138,911 | 8/1992 | Lan | 81/177.2 |

*Primary Examiner*—David A. Scherbel
*Assistant Examiner*—Joni B. Danganan
*Attorney, Agent, or Firm*—Gifford, Krass, Groh, Sprinkle, Anderson & Citkowski, P.C.

[57] ABSTRACT

An axially repositionable adapter for use with a ratchet assembly for providing telescoping and axial repositioning of an overall length of the adapter. A first elongate member includes a first tool bit engaging end and a second open end which defines a hollowed and axially extending interior. A second elongate member includes a first end which is mounted in a telescoping and axially inserting manner within the axially extending interior of the first elongate member and a second socket wrench engaging end. The first and second elongate members can also be reversed so that the first member is an inner member and the second member is a telescopically attached outer member. A plurality of individual apertures are formed along a selected surface of the second elongate member and are arranged in axially and spaced apart fashion. A lever mechanism is mounted to the first elongate member and includes a detent which seats within a selected one of the individual apertures in the second elongate member to maintain the first and second members in an interlocking position. A spring biases the detent in the locked position and is counteracted by a trigger which is depressed to unseat the detent from its associated aperture to permit the first and second members to be axially repositioned in inward and outward fashion relative to each other and the detent subsequently is reseated at a further selected aperture of the shaft which defines the desired and axially repositioned length of the shaft.

5 Claims, 3 Drawing Sheets

AXIALLY REPOSITIONABLE ADAPTER FOR USE WITH A RATCHET ASSEMBLY

BACKGROUND OF THE INVENTION

1. Field of the Invention

The present invention relates generally to hand tools and, more specifically, to an axially repositionable adapter for use with a ratchet assembly which includes first and second elongated members for enabling a user to apply a greater degree of translational and torsional forces and further providing a heavy duty shaft adjustment mechanism which is recess mounted in an unobtrusive fashion within a first selected one of the elongate members.

2. Description of the Prior Art

The prior art is well documented with numerous examples of extendable ratchet assemblies and torque rod assemblies. The professed advantage of such tools is to permit an overall length of the intermediate or adapter member to be selectively and axially readjusted in inward and outward fashion in response to whatever space restrictions are presented in a surrounding operating environment.

U.S. Pat. No. 4,602,890, issued to Duda, teaches a ratchet assembly and snap lock mechanism having telescoping inner and outer tubes, the inner tube having a row of ratchet teeth placed therein. A snap lock assembly includes a tubular mounting body which is threadably engaged with the outer tube and a latch member is disposed within the mounting body and reciprocates between a latching position for ratcheting engagement and unlatching position disengaged from the ratchet teeth. A spring urges the latching member to its latching position and an enlarged head carrying a pin lies in close proximity to a hexagonal outer surface of the mounting body when the latch member is engaged to prevent rotational movement of the latch member relative to the mounting body. The latch member is consequently unlatched to allow the pin to clear the mounting body and to permit rotational movement of the latch member.

U.S. Pat. No. 2,758,494, issued to Jenkins, teaches an extensible wrench set with magnetized heads in which magnetic means are used to maintain consecutive end-to-end positioned wrenches of the "Allen" variety to assemble an adapter member. Jenkins suffers from the most obvious shortcoming of the individual polygonal wrench members becoming magnetically disassociated from one another upon the occurrence of any significant non-linear application force and which can result in unsafe operation. Jenkins further does not provide releasable securing means for selectively accommodating any one of a plurality of attachable bit members.

U.S. Pat. No. 4,409,866, issued to McBride, teaches a tool assembly including a handle with a spring biased trigger means for permitting a selected insertable shank tool to be readjusted in an axial manner. The handle includes a through passageway substantially along its longitudinal axis and a cross section of an associated shank tool is sized so that it is slidably insertable within the handle. The tool handle further includes a body provided with a "U" shaped trigger, a forward leg of which is movable in a transverse slot extending therethrough the passageway in and through the handle and includes an aperture formed therein which is adapted to permit the shank of the tool to pass therethrough. A plurality of spaced apart notches are formed along an underside surface of the shank tool and are selectively engaged by the forward leg portion. A rear trigger leg also includes a small aperture which is engaged by a pin and the "U" shaped trigger member is biased in an upward direction by a coil spring which is mounted within a recess open to an exterior of the handle and pressing upwardly against the underside surface of the base member of the "U" shaped trigger so that the trigger member is displaced a considerable distance above the level surface of the handle.

While disclosing an effective hand tool device with repositionable shaft, the trigger assembly in McBride suffers from the shortcoming that the coil spring element which biases the trigger assembly projects outwardly from the recess mount a significant degree to a point exterior of the surface of the handle where is biases against the underside of the trigger. Having a coil spring in such an exposed arrangement is potentially harmful in that it could possibly slip out of alignment with the interconnecting base member of the "U" shaped trigger, causing the telescoping shaft to lose its retaining engagement with the handle. A further shortcoming of McBride involves the amount of biasing force that can be exerted by the spring and through the forward leg held within the selected notch in the shank without disengaging the shaft from the trigger. It is submitted that McBride does not teach a heavy-duty engaging mechanism for repositionally securing the shaft in an axial fashion to the handle. Additional examples of torque bar extensions for use with socket assemblies are illustrated in U.S. Pat. Nos. 2,963,930, issued to Clothier et al. and 3,306,639, issued to Lyon.

Finally, U.S. Pat. No. 2,592,978, issued to Trimboli, also discloses an interesting retractable tool device which includes a repositionable shank portion which is held within a handle. The shank includes a plurality of spaced apart and grooved slotted portions and a cylindrical head portion of the handle includes a spherical ball detent member which is biased inwardly by a spring so that it seats within a selected slotted portion. While illustrating an interiorly positioned spring member and detent, Trimboli suffers from the disadvantage that the spherical ball and spring arrangement also does not provide a heavy-duty type securing means for preventing inadvertent axial displacement of the shaft relative the gripping handle upon the application of an excessive degree of force, such as is necessary when loosening a partially corroded screw or like fastener.

SUMMARY OF THE PRESENT INVENTION

The present invention is an axially repositionable adapter for a ratchet assembly, the ratchet assembly also including a plurality of individual tool bits and a socket wrench. The adapter incorporates a having a heavy duty locking means for axial repositioning of a first elongate member relative to a second elongate member and which is an improvement over the prior art ratchet adapters and assemblies.

The first elongate member includes a first tool bit engaging end and a second open end which defines a hollowed and axially extending interior. An apertured portion is formed within the first elongate member at a selected location and communicates an exterior facing surface of the first member with the axially extending interior. A second elongate member includes a first inserting end for securably mounting in a telescoping and coaxially inserted fashion within the axially extending interior of the first member and also displays a second socket wrench engaging end opposite the first inserting end. The second elongate member is polygonal shaped in cross section and, upon coaxial insertion of the second elongate member within the axial interior of the first elongate member, is contoured to match the cross sectional shape of the axially extending interior of the first member and prevents the occurrence of rotational displacement or dislocation between the first and second elongate members. A plurality of individual apertures are formed along a selected polygonal surface of the second elongate member and are arranged in an axially and spaced apart fashion.

A lever mechanism is positioned within the apertured portion in the first elongate member and is arranged in a substantially level fashion with respect to the exterior facing surface of the first member. The lever mechanism according to a first preferred embodiment is a pivot member which is secured by a transversely mounted pin to the first member. A coil biasing spring is mounted at a first end of the pivot member and biases the associated end of the pivot member upwardly so that a detent extending from an opposite and downwardly biased end is seated within a selected one of the plurality of individual apertures in the axially extending surface of the second member in an engaged position. The pivot member is depressed at its first end so that the detent rotates in an upward and unseating position from its associated aperture, releasing the second elongate member from its locking arrangement with the first elongate member. The first and second elongate members may then be axially repositioned in either in inwardly or outwardly fashion relative to each other until a desired repositioned and overall length is achieved, upon which then the pivot member is released and the detent once again rotates downwardly due to the upwardly biasing action of the spring to reseat within a further selected one of the plurality of apertures.

The lever mechanism according to a second preferred embodiment is a substantially planar shaped plate member which is mounted to the first elongate member in a substantially perpendicular fashion relative to longitudinally extending direction of the first and second members. The planar shaped plate member is formed with a central aperture which is dimensioned to permit the elongate and polygonal second member to extend therethrough and is further capable of being actuated to a limited extent in both an upward and downward direction. A detent projects from an inwardly facing surface of the central aperture of the plate member and is received within a selected one of the plurality of individual apertures formed at spaced increments along the surface of the second elongate member. Biasing the detent in an engaged and seating position within its selected aperture is a coil spring which is mounted within a base surface of the first elongate member and biases against an opposing and outwardly facing surface of the plate shaped member. An actuating portion of the plate shaped member extends through the apertured portion and projects above the exterior surface of the first elongate member opposite the coil spring and detent. A trigger of the actuating portion projects a sufficient minor distance from the level surface of or is flush with the first elongate number and is depressed so that the biasing force of the spring is reversed and the detent is unseated from its selected individual aperture to permit the first and second elongate members of the adapter to be axially repositioned both towards and away from each other to adopt a desired overall axial length. Following axial repositioning of the shaft, the trigger is released and the coil spring once again biases the plate shaped member to seat the detent into a second selected aperture corresponding to the desired repositioned length of the elongate members which make up the adapter.

BRIEF DESCRIPTION OF THE DRAWING

Reference will now be had to the attached drawing, when read in combination with the following specification, wherein like reference numerals refer to like parts throughout the several views, and in which.

DESCRIPTION OF THE PREFERRED EMBODIMENTS

Figure 1:
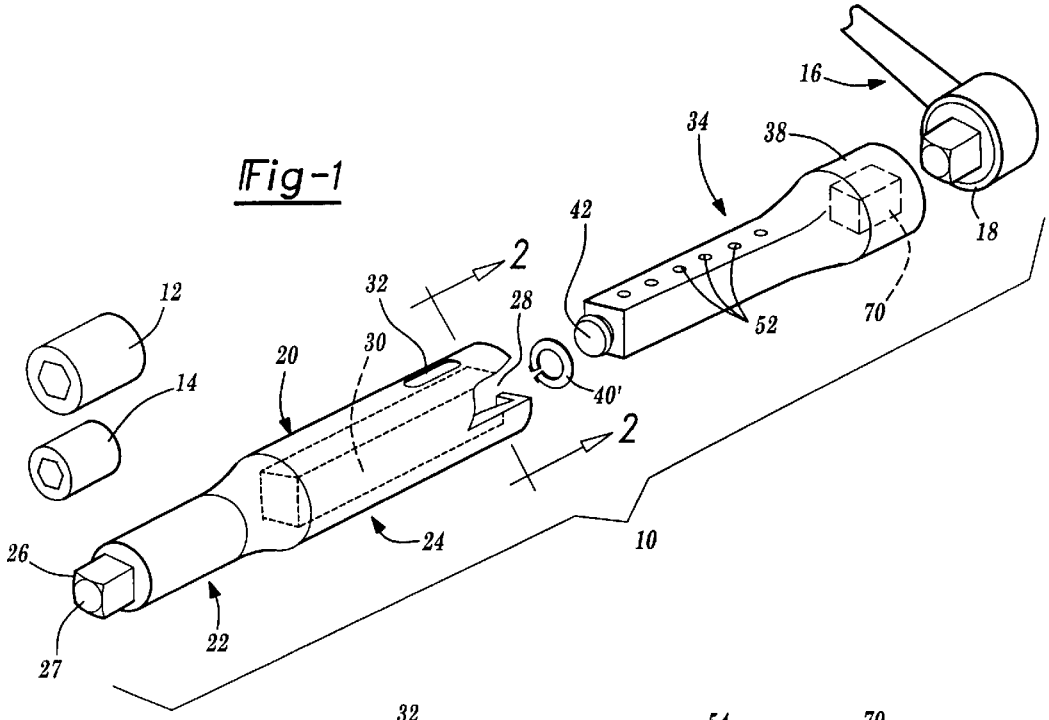
FIG. 1 is an exploded view of the axially repositionable adapter with first and second elongate members for use with a ratchet assembly according to a first preferred embodiment of the present invention.

Referring now to FIG. 1, an axially repositionable adapter 10 for use with a ratchet assembly is illustrated according to a first preferred embodiment of the present invention. The ratchet assembly typically consists of a plurality of individual tool bits, which are representatively illustrated as individual bits 12 and 14, and which are capable of being selectively attached to the adapter. A conventional socket wrench 16 includes a ratchet engaging head 18 for attaching to an opposite end of the adapter remotely from an attaching end of a selected one of the individual tool bits.

Referring again to FIG. 1, the adapter 10 according to the present invention includes a first elongate member 20 having a substantially cylindrically shaped outer configuration and with a reduced diameter forward portion 22 and an enlarged diameter rearward portion 24. A first tool bit engaging end 26, preferably a square-shaped projection for matching a like aperture in an associated tool bit, extends from a forward most point of the forward portion 22 and displays a spring loaded ball bearing 27 for securing the associated tool bit and a second open end 28 likewise is defined within a rearward most point of the rearward portion 24 and establishes a hollowed and axially extending interior of the first elongate member 20 which is represented in phantom at 30 in FIG. 1.

The hollowed and axially extending interior 30 of the first member 20 may be shaped in an polygonal fashion to establish a desired number of sides, such as is provided by a triangle, hexagon, octagon, etc., but is preferably square shaped in cross section to provide four sides for establishing rotatively resistive engagement with the second elongate member as will be shortly described. The first elongate member 20 is further constructed of a conventional material such as a durable metal, metal alloy or hardened plastic or polymer material, etc., which exhibits the necessary properties of strength and torsional resistance. An apertured portion 32 is formed in an axially extending and elongate slotted fashion within the first elongate member 20 at a select location and communicates an exterior facing surface of the first elongate member 20 with its hollowed and axially extending interior 30.

Referring again to FIG. 1, a second elongate member 34 is provided and includes a forward portion 36 which is cross sectionally shaped also as a rectangle and is dimensioned in a manner consistent with the bounding surfaces of the axially extending interior 30 of the first elongate member 20. A rearward portion 38 of the second elongate member 34 is likewise configured in a cylindrical and expanded fashion to include an end engaging aperture 40 within which is inserted a projecting male portion of the socket wrench head 18.

Figure 5:
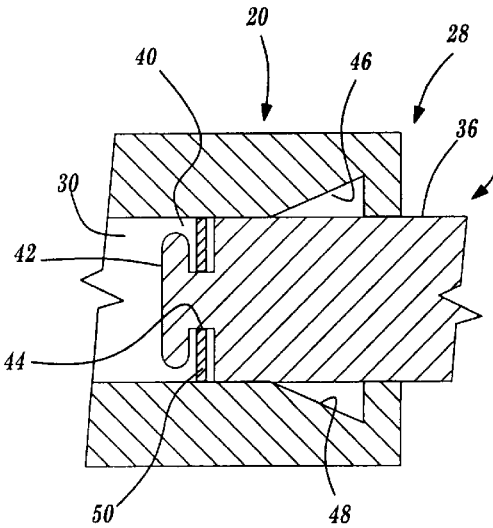
FIG. 5 is a cutaway view in section and illustrating the first and second elongate members and an interconnecting slip ring assembly in a first axial position.
Figure 6:
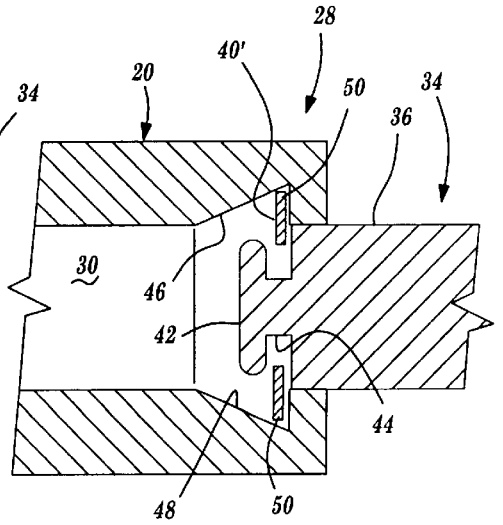
FIG. 6 is a cutaway view in section similar to that shown in FIG. 5 and further illustrating the axial and telescoping connection between the first and second elongate members at a second fully expanded axial position with the slip ring assembly engaged to permit axial separation of the elongate members from one another.

The second elongate member 34 is constructed of a similar material as the first elongate member 20 and, as is best illustrated in the cutaway side views of FIGS. 5 and 6, its forward portion 36 is securably mounted in a telescoping, axially slidable and inseparable fashion within the axially extending interior 30 of the first member 20 by a slip ring 40. The slip ring 40 is constructed of a spring-like metal which is radially outwardly biased and is engaged between a projecting button-head portion 42 extending from the forward portion 36 of the second member 30 and the main body of the second member 30 and is annularly disposed about a narrowed neck 44 which separates the button-head portion 42 from the forward portion 36.

As is best illustrated in FIG. 5, the forward portion 36 of the second elongate member 34 establishes an inserting end for mounting in a telescoping and coaxially inserted fashion within the axially extending interior 30 of the first elongate member 20 in a first established axial position. In a preferred embodiment, the axially extending interior 30 is further provided in an inwardly spaced and proximate location relative to the second open end 28 with outwardly sloping edges 46 and 48. As is best viewed in FIG. 6, continued axial separation of the first and second elongate members 20 and 34 causes the slip ring 40 to translate rearwardly along the axially extending interior 30 and outwardly along the sloping edges 46 and 48 of the axially extending interior 30 at the rear end to cause the slip ring 40 to radially expand to a position illustrated at 40' in which the slip ring abuts against inwardly facing shoulders 50 which define an abutting stop proximate the second open end 28 of the first member 20 and which prevent successive axial separation of the first and second elongate members 20 and 34 upon successive abutting contact of the button head portion 42 with an opposing face of the spring 40'.

Referring again to FIG. 1, arranged in axially extending fashion along a selected polygonal surface of the second elongate member 34 and at spaced apart increments are a plurality of individual apertures 52. The spaced apart apertures 52 are located in a specified range along the selected polygonal and axially extending exterior surface of the second elongate member 34 which generally corresponds to the forward portion 36 and further corresponds to a range of desired inward and outward axial adjustment of the first and second elongate members 20 and 34 in order to repositionably adjust and overall axial length of the adapter 10. The apertures 52 are preferably circular shape in section as illustrated in FIG. 1, however may be shaped in any other configuration as desired and are also each communicated with the apertured portion 32 upon a selected axial repositioning of the second elongate member 34 relative to the first elongate member 20 as will be subsequently described.

Figure 2:
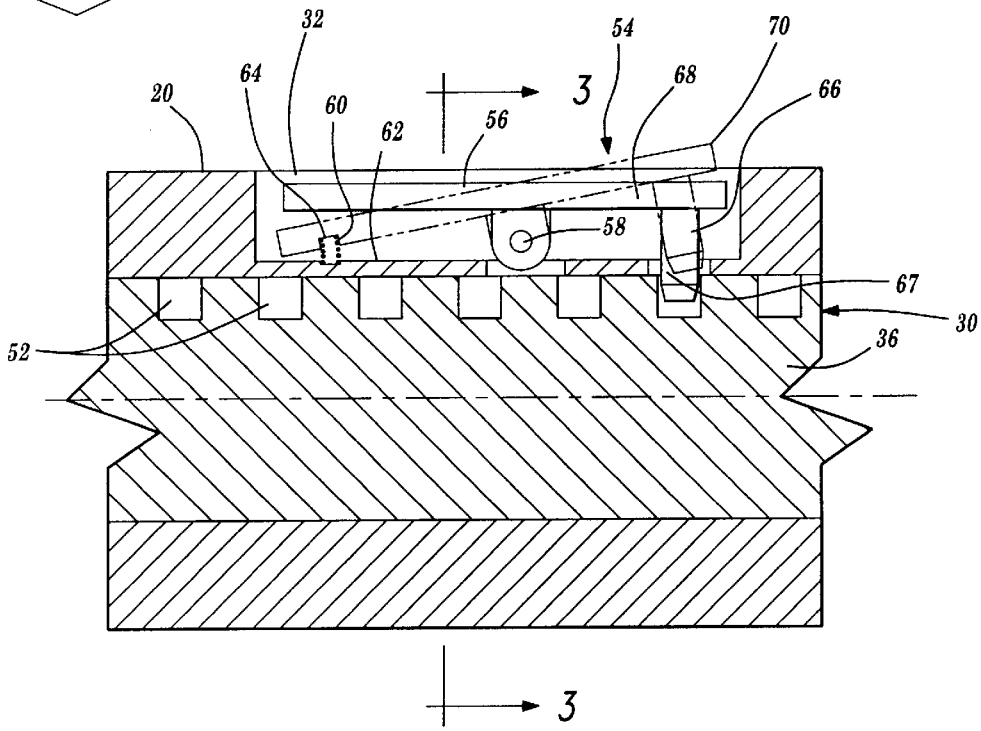
FIG. 2 is a cutaway view taken along line 2—2 of FIG. 1 and illustrating a cutaway of the adapter at a forward axial location of the first elongate member which shows the releasably locking engaging of the lever mechanism with biasing coil spring and inwardly facing detent engaging portion which engages into the second and inner elongated member according to the first preferred embodiment.

Referring to FIG. 2, lever mechanism 54 is provided according to a first preferred embodiment for releasably and repositionally locking the first and second elongate members 20 and 34 in a desired axial fashion. The lever mechanism 54 is a pivot member assembly which is secured within the apertured portion 32 of the first elongate member 20 and which includes an elongate arm 56 of any desired shape in cross section which is mounted by a transversely extending pin 58 to the body of the first member 20. A coil spring 60 is provided at a first selected end of the elongate arm 56 and is secured at one end to a base support 62 of the first elongate member 20 and at the other end within a recess 64 in the underside of the elongate arm 56.

Figure 3:
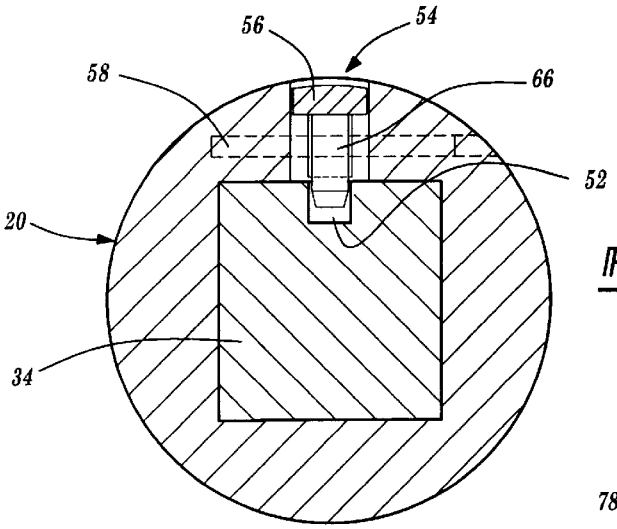
FIG. 3 is a cutaway view taken along line 3—3 of FIG. 2 and further showing the lever mechanism from an end view perspective according to the first preferred embodiment.

The coil spring 60 biases the first selected end of the elongate arm 56 in an upward direction so that a downwardly facing detent 66 of any desired shape is located at a corresponding rearward end of the arm 56 is downwardly rotated through an aperture 67 formed in the base support 62 and seated within a selected one of the plurality of like shaped shaft apertures 52 which is aligned with aperture 67. The pivot assembly 54 is easily operated simply by the user applying pressure with the thumb against the first selected end of the elongate arm 56, causing reverse biasing force against the spring 60 and the detent 66 to rotate in an upward and unseating direction from its associated shaft aperture 52. The first and second elongate members 20 and 34 may then be axially repositioned in a desired forward or rearward direction relative to each other as dictated by the range of apertures 52 located upon the selected surface of the second member 34 and the extend of axial adjustment permitted by the axially extending interior 30. As is also clearly illustrated in the partial view of FIG. 2 and the end view of FIG. 3, the pivot member assembly 54 in its undeflected and engaged position is arranged in a substantially level and flush manner, as illustrated at 68, with respect to the exterior of the first elongate member 20 and thereby precludes the possibility of a user's hand or fingers becoming jammed against the lever mechanism 50 in the event that the hand slides forwardly in a sudden and abrupt manner as a result of downwardly pressure applied against the socket wrench end. Upon depressing the spring 60, the elongate arm 56 then upwardly pivots to a position illustrated at 70 to permit axial repositioning.

Figure 4:
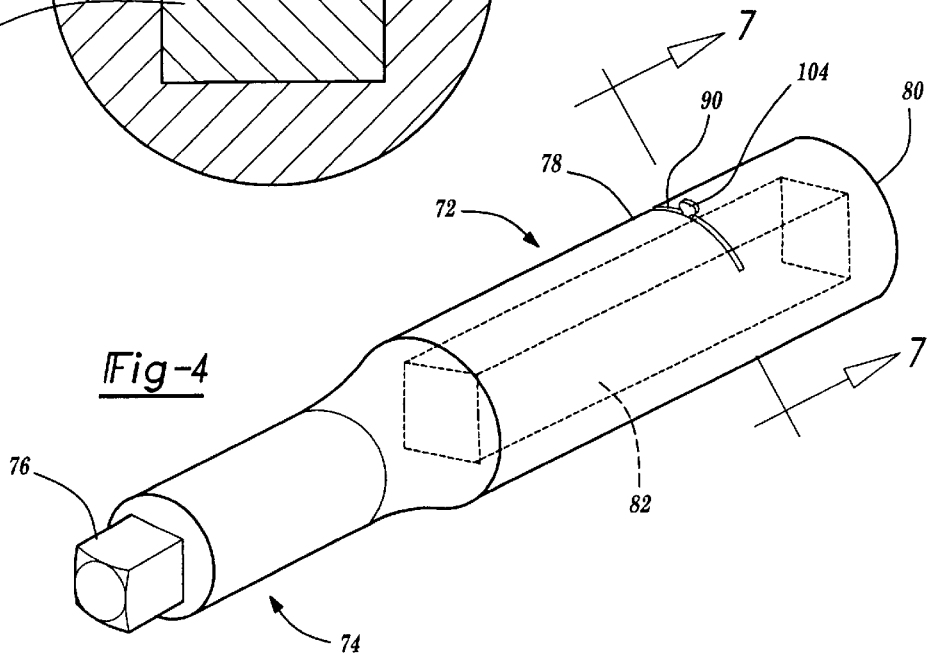
FIG. 4 is a view in perspective similar to that shown in FIG. 1 and illustrating a first elongate member with a lever mechanism according to a further preferred embodiment of the present invention.

Referring to FIG. 4, a perspective view is illustrated of a first elongate member 72 according to a further preferred embodiment of the present invention. The first elongate member 72 is substantially identical in most respects to the first elongate member 20 illustrated in FIG. 1 and includes a reduced diameter forward portion 74 terminating in a tool bit engaging end 76 and an enlarged diameter rearward portion 78 with an opposing and open second end 80 defining therein an axially extending interior 82 which is again illustrated as being rectangular shape in phantom. A second elongate member is likewise engaged within the first elongate member 72, the second member being identical in each and every respect to that illustrated at 34 in the first preferred embodiment, therefore repetition of this feature is not necessary for a detailed description of the second preferred embodiment.

Figure 7:
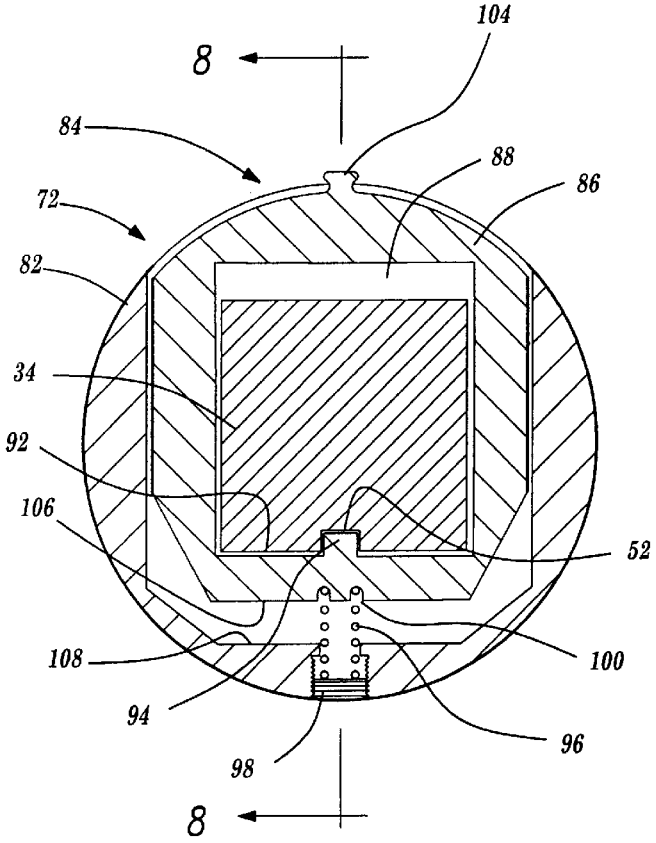
FIG. 7 is a cutaway view taken along line 7—7 of FIG. 4 and illustrating a plate shaped releasably lockable lever mechanism with detent in a seated position according to the further preferred embodiment of the present invention.
Figure 8:
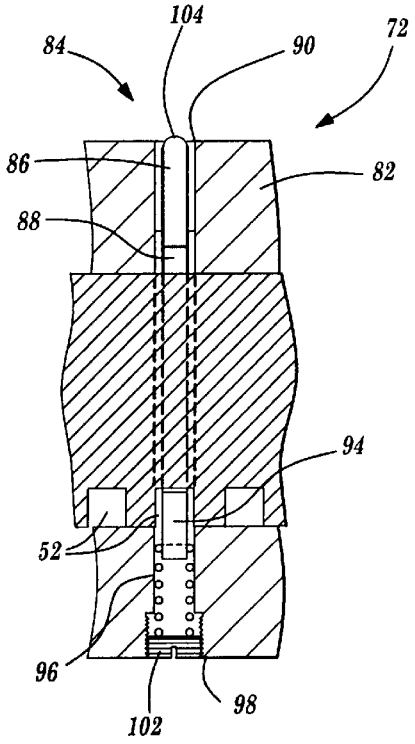
FIG. 8 is a cutaway view of the lever mechanism taken along line 8—8 in FIG. 7 and illustrating the projecting trigger and biasing coil spring and engaging detent from a corresponding side view.

Referring again to the perspective view of FIG. 4, as well as the cutaway views of FIGS. 7 and 8, a lever mechanism 84 is shown for use with the adapter of the ratchet assembly according to a further preferred embodiment of the present invention. The lever mechanism 84 according to the further embodiment is intended as a substitute for the pivot member assembly 54 of the first embodiment and, as previously stated, the remaining features of the adapter 10 remain substantially unchanged except as will now described.

The lever mechanism 84 includes a substantially planar shaped, and preferably rectangular, member 86 having a polygonal shaped central aperture 88 which is shaped similar in cross section to the cross sectional shape of the second elongate member 34 extending therethrough and is dimensioned so as to permit the planar shaped member 86 a limited degree of upward and downward actuation as is clearly evident in the illustration. As is best shown in FIGS. 4 and 8, a circumferentially extending and slotted apertured portion 90 is formed in the first elongate member 72 and defines a guide along which the planar shaped member 86 is permitted to vertically actuate.

The second elongate member 34 is positioned such that its row of axially spaced apart and longitudinally extending apertures 52 is arranged along a bottom facing surface 92 of the shaft second member 34. A detent 94 extends upwardly from an associated bottom edge of the plate shaped member 86 surrounding the central aperture 88 and is seated within a selected shaft aperture 52 through upwardly directed biasing of a coil spring 96. A lower end of the coil spring 96 is seated upon a bottom internal support 98 in the first elongate member and a corresponding upper end is seated within an annular groove 100 in the plate shaped member 86 (FIG. 7) along an edge opposite the inwardly directed detent 94. As is also shown in FIG. 8, the internal support 98 may be threadably engaged relative to the first elongate member and a slot 102 may permit a flat edged screwdriver (not shown) to adjust the inward or outward seating of the support 98, the effect of which will adjust the amount of upward bias which is exerted by the spring 96.

The planar shaped member 86 terminates along an upper edge thereof in a projecting tab portion 104 and provides the user with the ability to downwardly actuate the planar shaped member 86, upon pressing the tab inwardly, from an upwardly biased and seated position of the detent 94 within its associated shaft aperture 52. The spring 96 is reverse biased in response to the depression of the tab member 104 and the planar shaped member 86 is downwardly actuated until an associated bottom most edge 106 is in abutting contact with a bottom surface 108 of the second elongate member 34, at which point the detent 94 will be actuated to an unseated position relative its initial aperture 52 and which will then permit axial repositioning of the first and second elongate members in both inwardly and outwardly axial directions.

As is also clearly evident in the end view of FIG. 7, the second elongate member 34 is in an abutting and rotatively preventative arrangement with respect to the first elongate member 20 on every side of the planar shaped member 86 and is capable of only being repositioned in axial fashion once the planar shaped member 86 is unseated from its initially selected shaft aperture 52. The contour of the upper portion of the planar member 86 and tab member 104 is further such that only the tab member 104 will project a minimal degree beyond the exterior surface of the first elongate member 20 and maintains the overall flush appearance of the adapter.

Having described my invention, additional preferred embodiments will become apparent to those skilled in the art to which it pertains without deviating from the scope of the appended claims. Specifically, other types of spring biasing means could be utilized, such as leaf springs. Other types of lever mechanisms may also be employed, each of which is capable of providing heavy duty and releasably securable reinforcing engagement to the adapter. Also, a significant number of different cross sectionally shaped first and second elongate members could be utilized without departing from the scope of the present invention. Also, it is envisioned that the axially extending and hollowed interior may be formed within a second of the elongated members and that the equivalent of the first member may be provided with the individual engaging apertures in a substantially reversed fashion to the preferred embodiments described and without departing from the scope of the invention. Reference is now made to the appended claims in support of the above disclosed embodiments and further preferred embodiments.

We claim:

1. An axially repositionable adapter for a ratchet assembly, the ratchet assembly including a plurality of individual tool bits and a socket wrench, said axially repositionable adapter comprising:

a first elongate member having a first tool bit engaging end and a second open end defining a hollowed and axially extending interior, an apertured portion being formed at a selected location along said first elongate member which communicates an exterior facing surface of said first member with said axially extending interior;

a second elongate member having a first inserting end for securably mounting in a telescoping and coaxially inserted fashion within said axially extending interior of said first elongate member and a second socket wrench engaging end, said second elongate member defining a polygonal shape in cross section which is contoured to match that of said hollowed interior of said first elongate member so as to prevent rotation dislocation occurring between said first and second elongate members, a plurality of individual apertures formed along a selected surface of said second elongate member and being arranged in an axially and spaced apart fashion; and lever means positioned within said apertured portion of said first elongate member and securing to said first member in a substantially level and flush fashion with respect to said exterior facing surface, said lever means including a detent which seats within a first selected one of said individual apertures arranged along said second elongate member and a spring which is securably attached at an interior location within said first elongate member and which biases said lever means in a first locking direction, said lever means further including a pivot member assembly including an elongate arm which is secured by a transversely extending pin member to said first elongate member, said spring upwardly biasing a first selected end of said elongate arm on a first selected side of said pin member and downwardly biasing a second selected end of said elongate arm on an opposing side of said pin member, said detent extending from said second selected end which seats within a first selected one of said individual apertures arranged along said second elongate member, said detent projecting downwardly from said second end of said arm through said axially extending interior of said first elongate member and seating within said first selected aperture of said second elongate member;

said lever means being actuated in a second and opposite releasing direction to unseat said detent from said first selected aperture and to permit said first and second elongate members to be axially repositioned in both inwardly and outwardly fashion relative to each other so as to establish a modified overall length of said adapter, said lever means being released so that said detent reseats within a second selected aperture.

2. The axially repositionable adapter for a ratchet assembly as described in claim 1, further comprising means for preventing complete axial withdrawal of said second elongate member from within said first elongate member.

3. The axially repositionable adapter for a ratchet assembly as described in claim 2, said withdrawal prevention means further comprising:

said axially extending interior including outwardly sloping edges which terminate in an annular extending and inwardly facing shoulder in proximity to said second open end;

a button head portion longitudinally spaced forwardly from said first inserting end of said second elongate member by a narrowed neck; and a slip ring mounting about said neck and fixedly retained between said second elongate member and said button head portion;

said slip ring radially expanding during rearward axial travel along said outwardly sloping edges and abutting against said inwardly facing shoulder one a first face and said button head portion on an opposing face to define an outer most permitted axial length for said adapter.

4. The axially repositionable adapter for a ratchet assembly as described in claim 1, further comprising said tool bit engaging end of said first elongate member being capable of selectively receiving any one of a plurality of socket bit attaching portions.

5. The axially repositionable adapter for a ratchet assembly as described in claim 1, said axially extending interior of said first elongate member and a forward portion of said second elongate member each defining a rectangular shape in cross section.

* * * * *